US008894507B2

(12) United States Patent
Boyd et al.

(10) Patent No.: US 8,894,507 B2
(45) Date of Patent: Nov. 25, 2014

(54) GOLF CLUB HEAD OR OTHER BALL STRIKING DEVICE WITH THERMOREACTIVE FACE

(75) Inventors: Robert Boyd, Euless, TX (US); Rachel M. Thurston, Columbus, OH (US); Jeffrey A. Hadden, Delaware, OH (US); Ivan E. Tornes, Hilliard, OH (US)

(73) Assignee: Nike, Inc., Beaverton, OR (US)

( * ) Notice: Subject to any disclaimer, the term of this patent is extended or adjusted under 35 U.S.C. 154(b) by 425 days.

(21) Appl. No.: 13/252,780

(22) Filed: Oct. 4, 2011

(65) Prior Publication Data

US 2013/0085012 A1 Apr. 4, 2013

(51) Int. Cl.

*A63B 53/00* (2006.01)
*A63B 53/08* (2006.01)
*A63B 53/04* (2006.01)

(52) U.S. Cl.

CPC ..... *A63B 53/0466* (2013.01); *A63B 2053/0425* (2013.01); *A63B 2209/00* (2013.01); *A63B 2209/02* (2013.01); *A63B 53/08* (2013.01); *A63B 53/04* (2013.01); *A63B 2053/042* (2013.01)

USPC ..... 473/342; 473/329; 473/349; 473/350; 473/345

(58) Field of Classification Search

USPC ..... 473/342, 329, 345, 349, 350
See application file for complete search history.

(56) References Cited

U.S. PATENT DOCUMENTS 4,681,322 A * 7/1987 Straza et al. ..... 473/329
5,176,384 A * 1/1993 Sata et al. ..... 473/329
5,299,807 A * 4/1994 Hutin ..... 473/329
5,425,535 A 6/1995 Gee
5,620,382 A 4/1997 Cho et al.
5,647,808 A * 7/1997 Hosokawa ..... 473/349
5,674,132 A 10/1997 Fisher
5,769,735 A * 6/1998 Hosokawa ..... 473/332
5,807,189 A * 9/1998 Martin et al. ..... 473/342
5,807,190 A * 9/1998 Krumme et al. ..... 473/342
5,899,818 A * 5/1999 Zider et al. ..... 473/324
6,165,081 A * 12/2000 Chou ..... 473/329
6,277,033 B1 * 8/2001 Krumme et al. ..... 473/342
6,319,149 B1 * 11/2001 Lee ..... 473/342

(Continued)

FOREIGN PATENT DOCUMENTS

EP 737493 10/1996
JP 8196666 8/1996

OTHER PUBLICATIONS

JmMedical, Nitional Technical Properties, Jan. 29, 2014, Johnson Matthey Medical Components, 3 pages.*
NDC, The Shape Memory Effect, 1995, NDC, 1-13.*

(Continued)

*Primary Examiner* — Gene Kim
*Assistant Examiner* — Matthew B Stanczak
(74) *Attorney, Agent, or Firm* — Banner & Witcoff, Ltd.

(57) ABSTRACT

A ball striking device, such as a golf club, includes a head that includes a face having a ball striking surface configured for striking a ball and a body connected to the face and extending rearward from the face. The face has an area of highest response located proximate a center of the ball striking surface. The face is formed of a first material and a second material that forms at least a portion of the area of highest response. The second material has a thermal modulus response that is different from a thermal modulus response of the first material.

19 Claims, 15 Drawing Sheets

(56) References Cited

U.S. PATENT DOCUMENTS

| | | | | |
|---|---|---|---|---|
| 6,364,789 | B1 * | 4/2002 | Kosmatka | 473/329 |
| 6,979,270 | B1 * | 12/2005 | Allen | 473/290 |
| 7,281,990 | B2 * | 10/2007 | Hagood et al. | 473/329 |
| 7,651,408 | B2 * | 1/2010 | Hagood et al. | 473/329 |
| 7,682,262 | B2 * | 3/2010 | Soracco et al. | 473/329 |
| 7,785,213 | B2 * | 8/2010 | Matsunaga et al. | 473/342 |
| 8,128,509 | B2 * | 3/2012 | Soracco et al. | 473/329 |
| 8,409,032 | B2 * | 4/2013 | Myrhum et al. | 473/342 |
| 2002/0037776 | A1 * | 3/2002 | Krumme et al. | 473/329 |
| 2003/0207722 | A1 * | 11/2003 | Hess et al. | 473/282 |
| 2003/0207727 | A1 * | 11/2003 | Kakiuchi | 473/345 |
| 2004/0043832 | A1 * | 3/2004 | Lee et al. | 473/342 |
| 2004/0176182 | A1 * | 9/2004 | Krumme et al. | 473/342 |
| 2006/0154746 | A1 * | 7/2006 | Hagood et al. | 473/345 |
| 2008/0032813 | A1 * | 2/2008 | Hagood et al. | 473/329 |
| 2013/0040756 | A1 * | 2/2013 | Myrhum et al. | 473/342 |

OTHER PUBLICATIONS

ISR & WO mailed Dec. 13, 2012, for PCT Application No. PCT/US2012/057532.

* cited by examiner

GOLF CLUB HEAD OR OTHER BALL STRIKING DEVICE WITH THERMOREACTIVE FACE

TECHNICAL FIELD

The invention relates generally to ball striking devices, such as golf clubs and heads. Certain aspects of this invention relate to golf clubs and golf club heads having a face that exhibits thermoreactive behavior to change the modulus of at least a portion of the face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club should meet the golf ball square (or substantially square) to the desired target path. Moreover, the golf club should meet the golf ball at or close to a desired location on the club head face (i.e., on or near a "desired" or "optimal" ball contact location) to reliably fly straight, in the desired direction, and for a desired distance. Off-center hits that deviate from squared contact and/or are located away from the club's desired ball contact location may tend to "twist" the club face when it contacts the ball, thereby sending the ball in the wrong direction, often imparting undesired hook or slice spin, and/or robbing the shot of distance. Thus, when the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories.

The energy and velocity transferred to the ball by a golf club may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing USGA limit (e.g. 0.83), which may change over time. However, because golf clubs are typically designed to contact the ball at or around the center of the face, off-center hits may result in less energy being transferred to the ball, decreasing the distance of the shot. The COR at a specific location on the club head can be related to the modulus of elasticity at the impact location, as well as the modulus of other areas of the face spaced away from the impact location. Similarly, the contact time between the ball and the face during impact can affect energy transfer. Generally, a more flexible (lower modulus) face will produce higher contact times, resulting in greater energy transfer. The contact time is currently limited by the USGA at 257 μs, according to the USGA Characteristic Time (CT) test. Club head features that can increase the energy transferred to a ball during impact can be advantageous.

It is common for professional golfers and other experienced golfers to have higher swing speeds (i.e., the speed of the club head at or around impact with the ball) than less experienced golfers. Many club heads are designed to deliver optimal performance at higher swing speeds, and may offer less optimal performance at lower swing speeds. Accordingly, club head features that can improve performance at lower swing speeds can prove to be advantageous for use by less experienced golfers.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face having a ball striking surface configured for striking a ball and a body connected to the face and extending rearward from the face. The face has an area of highest response located proximate a center of the ball striking surface. The face is formed of a first material and includes an insert forming at least a portion of the area of highest response, with the insert being formed of a second material. The second material has a thermal modulus response that is different from a thermal modulus response of the first material.

According to one aspect, the insert may be located behind the ball striking surface, such that an entirety of the ball striking surface is formed of the first material, for example, the insert may be located within a recess on the inner surface, such that an entirety of the ball striking surface is formed of the first material. In another embodiment, the insert may form at least a portion of the ball striking surface.

According to another aspect, the second material has a modulus at ambient conditions that is within 5% of a modulus of the first material at ambient conditions. The heat generated by an impact of a golf ball on the ball striking surface of at least 90 ft/s is sufficient to reduce the modulus of the second material to at least 20% lower than the modulus of the first material, due to the different thermal responses of the first and second materials.

Additional aspects of the invention relate to a golf club head that includes a face having a ball striking surface and an inner surface opposite the ball striking surface, and body connected to the face and extending rearward from the face, with the body and the face defining an internal cavity behind the face. The face has an area of highest response located proximate a center of the ball striking surface, and at least a portion of the area of highest response is formed of a material with a thermally-variable modulus. As such, the material has a first modulus due to heat generated by an impact of a golf ball on the ball striking surface at about 90 to 130 ft/s and a second modulus due to heat generated by an impact of the golf ball on the ball striking surface at about 160 ft/s, the second modulus being no more than 5% different from the first modulus.

According to one aspect, the material forming the at least a portion of the area of highest response is formed by an insert connected to the face, and a majority of the face is formed of a second material having a thermal modulus response that is different from a thermal modulus response of the material of the insert.

According to another aspect, the material may be formed in a first molecular phase at ambient conditions, and the heat generated by an impact of a golf ball on the ball striking surface at about 90 ft/s or more is sufficient to cause a portion of the material local to an impact site to change to a second molecular phase, the second molecular phase having a lower modulus than the first molecular phase.

According to a further aspect, the material has a third modulus at ambient conditions, the third modulus being at least 20% greater than the first modulus.

Further aspects of the invention relate to a golf club head that includes a face having a ball striking surface and an inner surface opposite the ball striking surface, a body connected to the face and extending rearward from the face, and a thermally-active device connected to the face. The thermally-active device is configured to change a temperature of at least a portion of the face to change a modulus of the at least a portion of the face.

According to one aspect, the thermally-active device may be a heating device configured to heat the at least a portion of the face and/or a cooling device configured to cool the at least a portion of the face.

According to another aspect, the thermally-active device may be a thermoelectric device or may change temperature based on a chemical reaction.

According to a further aspect, the face has an area of highest response located proximate a center of the ball striking surface, and the thermally-active device is configured to change the temperature of at least a portion of the area of highest response.

According to yet another aspect, the thermally-active device is configured to change the temperature of a portion of the face local to the thermally-active device, relative to a portion of the face spaced from the thermally-active device. In one embodiment, the thermally-active device is configured to change the temperature of a majority of the face.

According to a still further aspect, the head may further include a power generation device in communication with the thermally-active device. The power generation device is configured to supply power to the thermally-active device.

According to an additional aspect, the head may further include an actuator in communication with the thermally-active device. The actuator is configured to activate the thermally-active device to change the temperature of the at least a portion of the face. The actuator may be located on the shaft of a golf club that includes the head.

More additional aspects of the invention relate to a golf club head including a face having a ball striking surface and an inner surface opposite the ball striking surface, and a body connected to the face and extending rearward from the face. The face has an area of highest response located proximate a center of the ball striking surface. At least a portion of the area of highest response is formed of a material that is formed in a first molecular phase at ambient conditions. The heat generated by an impact of a golf ball on the ball striking surface at about 90 ft/s or more is sufficient to cause a portion of the material local to an impact site to change to a second molecular phase having a different modulus than the first molecular phase.

According to one aspect, the material is formed in the second molecular phase as a result of the impact of the golf ball on the ball striking surface at about 90 to 130 ft/s and is also formed in the second molecular phase as a result of the impact of the golf ball on the ball striking surface at about 160 ft/s.

According to another aspect, the material may be formed by an insert connected to the face. In one embodiment, a majority of the face may be formed of a second material having a thermal modulus response that is different from a thermal modulus response of the material of the insert. The insert may be located behind the ball striking surface, such that an entirety of the ball striking surface is formed of the first material, or the insert may form at least a portion of the ball striking surface.

Still further aspects of the invention relate to a method that includes providing a golf club head as described above, and connecting an insert to the face, as described above.

Other aspects of the invention relate to golf clubs that include a golf club head as described above and a shaft connected to the head, or a set of golf clubs including at least one golf club having a head as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
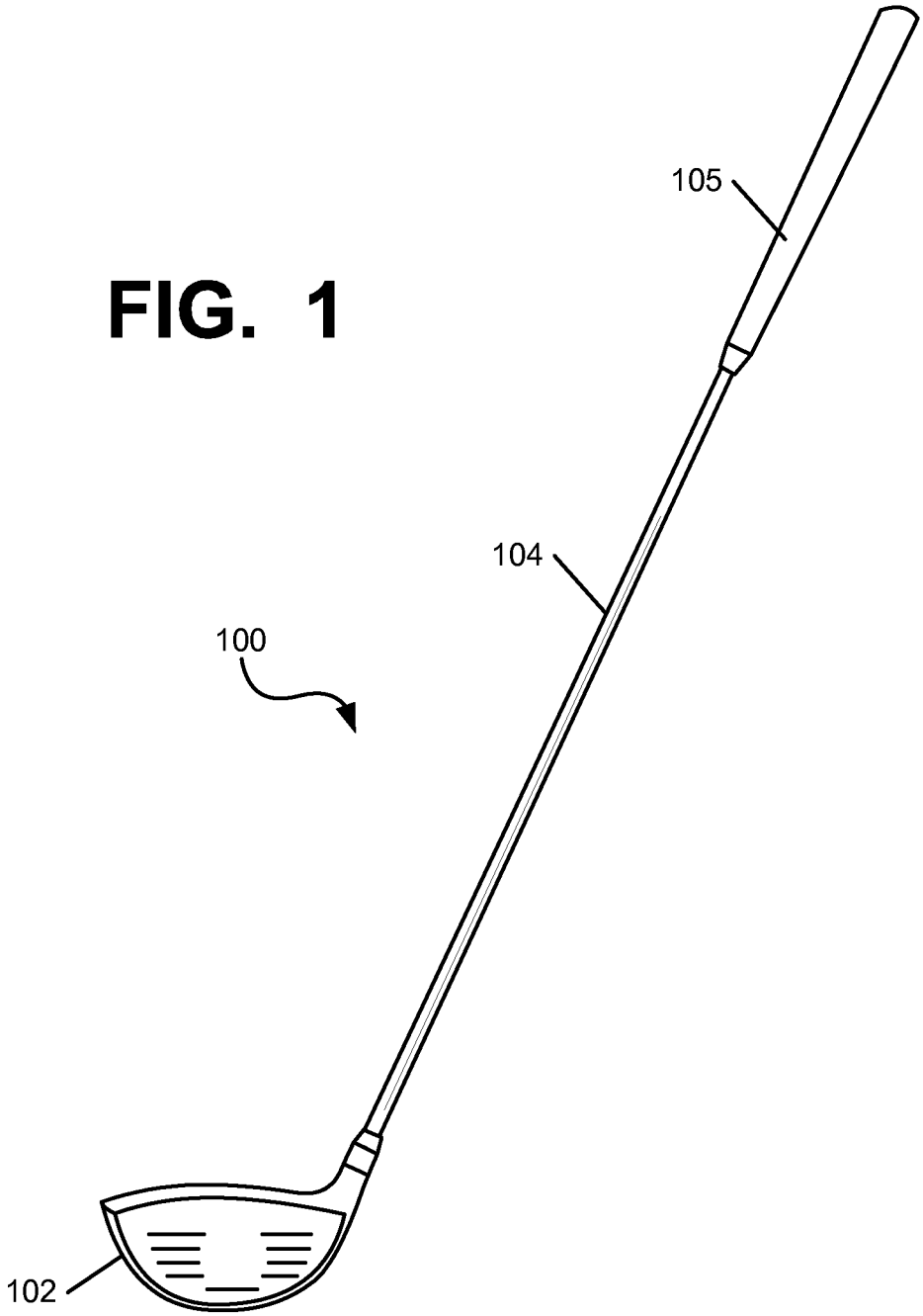
FIG. 1 is a front view of an illustrative embodiment of a wood-type ball striking device according to aspects of the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

"Modulus" means the elastic modulus of a material, specifically Young's modulus, which can be determined using standardized testing procedures.

"Thermal modulus response" is a material property reflecting the degree with which the modulus of the material changes due to changes in temperature. The thermal modulus responses of several materials are graphically illustrated in a conceptual manner in FIG. 3A.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface is a substantially flat surface on one face of the ball striking head. It is understood that some golf clubs or other ball striking devices may have more than one ball striking surface. Some more specific aspects of this invention relate to wood-type golf clubs and golf club heads. Alternately, some aspects of this invention may be practiced with iron-type golf clubs and golf club heads, hybrid clubs, chippers, putters, etc.

According to various aspects of this invention, the ball striking device may be formed of one or more of a variety of materials, such as metals (including metal alloys), ceramics, polymers, elastomers, composites (including fiber-reinforced composites or nano- and micro-particle reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, filament winding, compression molding, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIG. 1, which illustrates an example of a ball striking device 100 in the form of a golf driver, and FIG. 11, which illustrates an example of a ball striking device 600 in the form of an iron-type golf club, in accordance with at least some examples of this invention.

Figure 2:
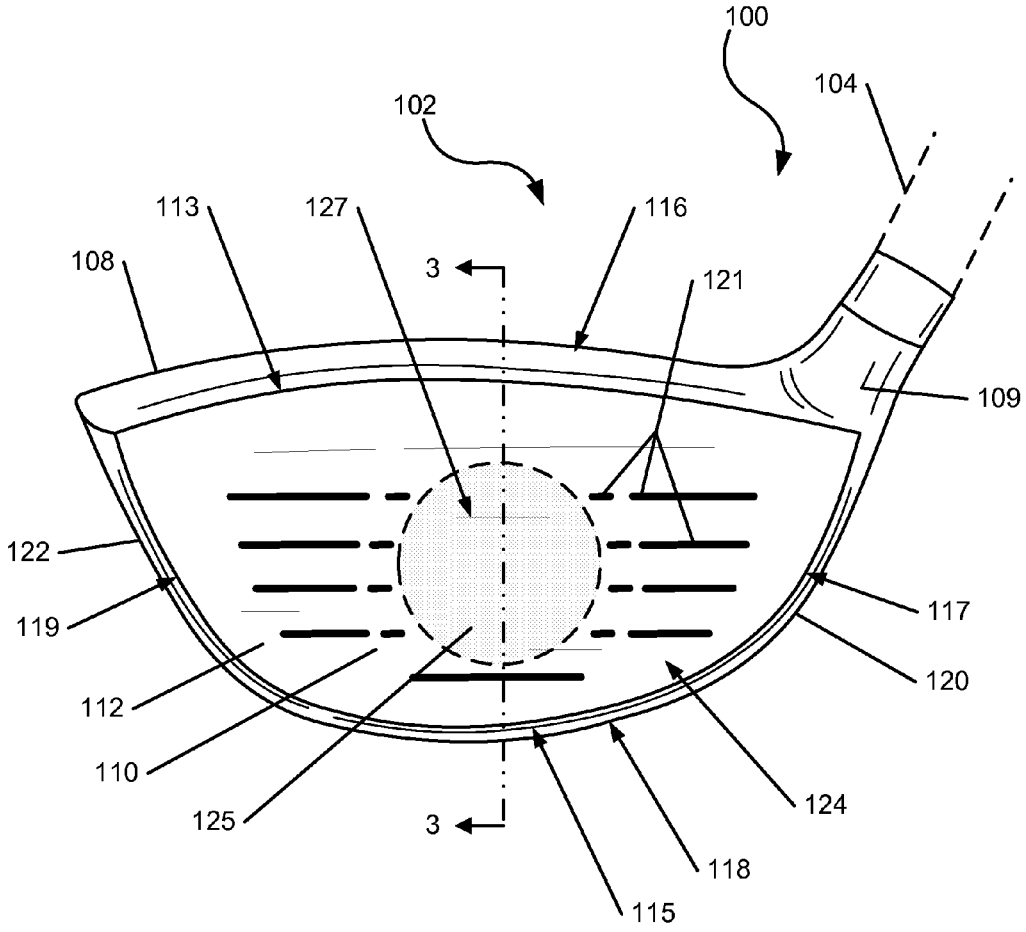
FIG. 2 is a front view of an illustrative embodiment of a head of the ball striking device of FIG. 1.
Figure 3:
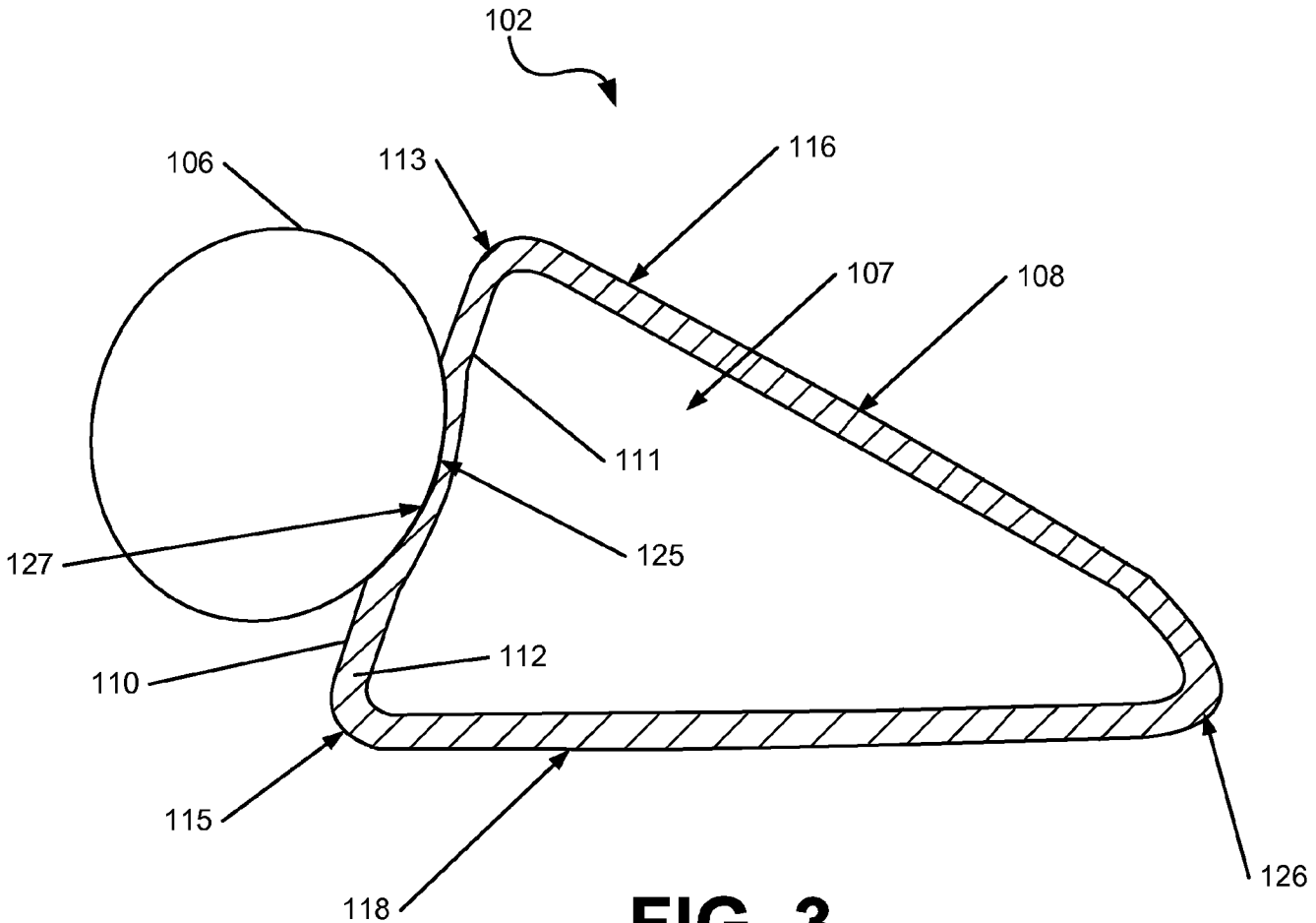
FIG. 3 is a cross-section view of the head of FIG. 2, taken along lines 3-3 of FIG. 2, showing an impact with a ball.

FIGS. 1-3 illustrate a ball striking device 100 in the form of a golf driver, in accordance with at least some examples of the invention, and FIGS. 4-10 illustrate various additional embodiments of a golf driver in accordance with aspects of the invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver, intended to hit the ball 106 accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the illustrative embodiment illustrated in FIGS. 1-3, the head 102 has a hollow structure defining an inner cavity 107 (e.g., defined by the face 112 and the body 108). Thus, the head 102 has a plurality of inner surfaces defined therein. In one embodiment, the hollow inner cavity 107 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 107 may not be completely enclosed in some embodiments. In the embodiment illustrated in FIGS. 1-3, the body 108 of the head 102 has a squared or rectangular rear profile. In other embodiments, the body 108 of the head 102 can have another shape or profile, including a rounded shape or other any of a variety of other shapes. In still further embodiments, the cavity may be evacuated under negative pressure. It is understood that such shapes may be configured to distribute weight away from the face 112 and/or the geometric/volumetric center of the head 102, in order to create a lower center of gravity and/or a higher moment of inertia. The body 108 may be connected to a hosel 109 for connection to a shaft 104, as described below.

The face 112 is located at the front 124 of the head 102, and has a ball striking surface 110 located thereon and an inner surface 111 opposite the ball striking surface 110. The ball striking surface 110 is typically an outer surface of the face 112 configured to face a ball 106 in use, and is adapted to strike the ball when the device 100 is set in motion, such as by swinging. The face 112 is defined by a plurality of peripheral edges, including a top edge 113, a bottom edge 115, a heel edge 117, and a toe edge 119. Additionally, in this embodiment, the face 112 has a plurality of face grooves 121 on the ball striking surface 110, which do not extend across the geometric center of the face 112. In another embodiment, such as a fairway wood head a hybrid wood-type head, the face 112 may have grooves 121 that extend across at least a portion of the hot zone of the face 112.

As shown, the ball striking surface 110 is relatively flat, occupying most of the face 112. For reference purposes, the portion of the face 112 nearest the top face edge 113 and the heel 120 of the head 102 is referred to as the "high-heel area" the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. For example, in one embodiment, face 112 may be formed as part of a face frame member with the body 108 being partially or wholly formed by one or more separate pieces connected to the face frame member, with a wall or walls extending rearward from the edges of the face 112. This configuration (not shown) is also known as a "cup face" structure. Additionally, at least a portion of the body 108 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining Other known techniques for joining these parts can be used as well, including many mechanical joining techniques, including releasable mechanical engagement techniques. If desired, the hosel 109 may be integrally formed as part of the face frame member. Further, a gasket (not shown) may be included between the cup face structure and the backbody member.

The ball striking device 100 may include a shaft 104 connected to or otherwise engaged with the ball striking head 102, as shown in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

In general, FIGS. 1-3 illustrate a head 102 that has a face 112 that is at least partially formed of a material with a thermally variable modulus, meaning that the elastic modulus of the material changes based on temperature. An impact between the face 112 and the ball 106 generates an amount of heat, at least some of which is absorbed by the face 112, changing the temperature of the face 112 at least in an area proximate the impact. The material may have a thermally-variable modulus that causes the modulus to change to a significant degree due to the heat absorbed by the face 112 during impact. In one embodiment, the energy of an impact of a ball on the face 112 is between 10-100 Joules, and the resultant temperature rise of the face may be between 0.1° C. and 5° C., depending on materials, swing speed, and other conditions. FIG. 2 schematically illustrates an impact zone 125 between the ball 106 and the face 112, which causes the face 112 to deform within the impact zone 125 and generates heat that is absorbed by the portions of the face 112 within the impact zone 125. It is understood that the impact zone 125 shown in FIGS. 2-3 corresponds to an impact at or around the area of highest response 127 of the face 112, which, in a driver-type club head 102, is typically at or around the geometric center of the face 112. FIG. 3 illustrates deformation of the face 112 caused by the impact. It is understood that the degree of deformation of the face 112 in FIG. 3 may be exaggerated for the purposes of showing detail. In one embodiment, the modulus of at least part of the area of the face 112 local to the impact zone 125 may change at least 10% due to heat and pressure generated by an impact of the ball 106 on the ball striking surface 110 at a particular swing speed during impact, as described below. In another embodiment, the modulus may change up to 50% at high swing speeds.

Figure 3A:
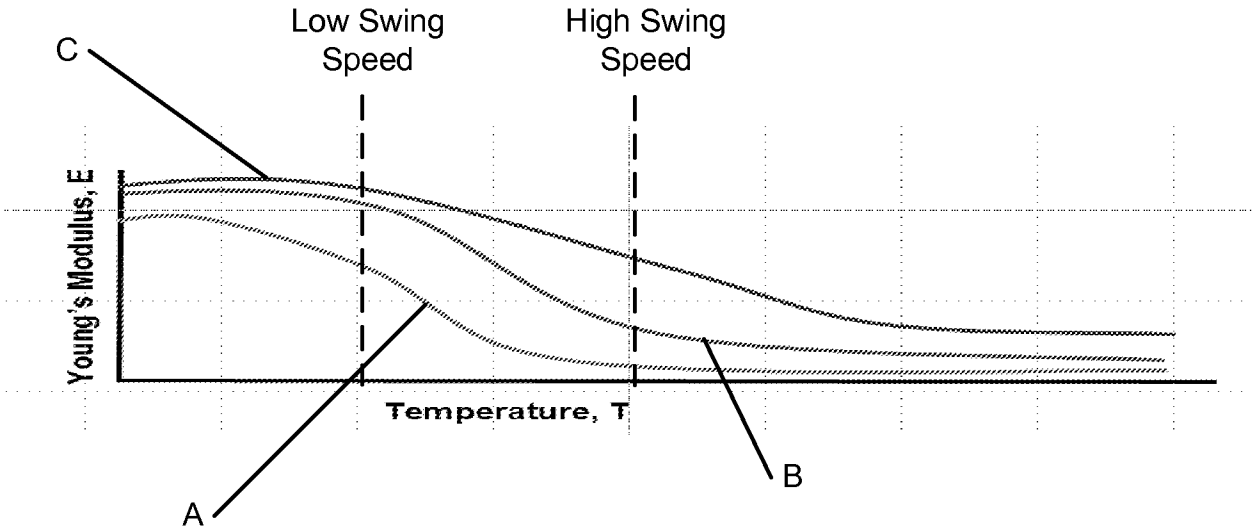
FIG. 3A is a graph conceptually illustrating thermal modulus responses for a variety of different materials.

As one example, a material with a thermally variable modulus can produce an increased "trampoline" effect and increased response (i.e. energy and/or velocity transfer) during impact. In such an example, the heat that is generated during impact can reduce the modulus of the material in the impact zone 125 to make the local material more flexible, while the surrounding material remains relatively stiffer. This creates an impact structure similar to an edge-supported trampoline, having a flexible center suspended by a stiff perimeter, leading to increased trampoline effect and/or increased contact time, and thus increased energy transfer. FIG. 3 illustrates such an impact. In one embodiment, the heat generated by the ball 106 during impact may change the modulus of the areas of the face 112 local to the impact zone 125 so that the modulus is at least 10% different relative to areas of the face 112 that are spaced away from the impact zone 125. Additionally, the amount of modulus change can be customized to the swing speed of a golfer, because impacts at greater velocity produce more heat. For example, for a golfer with a lower swing speed, a material may be selected such that the modulus of the areas of the face 112 local to the impact is at least 10% lower than at ambient conditions (i.e. room temperature) due to heat generated at swing speeds of 90 to 130 ft/s. In another example, for a golfer with a higher swing speed, a material may be selected such that the modulus of the areas of the face 112 local to the impact is at least 20% lower due to heat generated at swing speeds of at least 155 ft/s or at least 160 ft/s. FIG. 3A illustrates how the moduli of several different materials change based on temperature (which is indicative of swing speed), and a material can be selected for a particular swing speed accordingly. Material A in FIG. 3A represents one example of a material that can utilize heat generated during impact to produce a flexible impact zone 125 and a stiff surrounding area, resulting in an increased trampoline effect at many different swing speeds. Further customization is possible.

As another example, a material with a thermally variable modulus can produce increased face flexibility at a wider range of swing speeds. For example, many golf clubs are designed based on performance at a typical professional golfer swing speed of 160 ft/s. The COR (coefficient of restitution) test is performed at this swing speed, and many existing club heads 102 offer optimal performance at or around this swing speed. However, the faces 112 of such club heads 102 may have less flexibility, and consequently less deformation and trampoline effect, at lower swing speeds. A material with a thermally variable modulus can be selected to provide a decreased modulus due to heat produced at a lower swing speeds such as 90 to 130 ft/s, allowing for more flexibility at such swing speeds. Additionally, the material may be selected to provide a decreased modulus at such lower swing speeds, with little to no further decrease in modulus at higher swing speeds, as seen in the graph in FIG. 3A. For example, a material may experience a decrease in modulus of at least 20% due to heat generated at lower swing speeds of 90 to 130 ft/s, while having a further change in modulus of no more than 5% at a higher swing speed of 160 ft/s. The material may also have a modulus at ambient conditions that is at least 20% greater than the modulus at the range of lower swing speeds. As similarly described above, FIG. 3A illustrates how the moduli of several different materials change based on temperature (which is indicative of swing speed), and a material can be selected for a particular swing speed accordingly. Materials A and B in FIG. 3A represent examples of materials with a thermally variable modulus that can be effective for lower swing speeds, and Material C in FIG. 3A represents one example of a material with a thermally variable modulus that can be effective for higher swing speeds. Further customization is possible.

Below are described several different general and specific embodiments for creating a face having a thermally variable modulus response in accordance with aspects of the present invention. Generally, such embodiments may utilize a single material having a selected thermal modulus response, or multiple materials having different thermal modulus responses.

In one embodiment, a head 102 as shown in FIGS. 2-3 may have a face 112 made of a single material that produces a thermal modulus response as described above, such as to produce increased trampoline effect at any swing speed, or to produce greater flexibility at a particular swing speed. Such a single-material face 112 can produce increased trampoline effect and/or greater flexibility around the impact zone 125 for impacts on nearly any portion of the face 112, and not only in the area of highest response 127 of the face 112. This single material of the face 112 can be a metal, ceramic, composite, or other material, including a layered composite material. A layered or laminate composite may contain a plurality of alternating layers of materials having different moduli, such as a titanium-carbon fiber composite layered structure (e.g. TiGr) or an aluminum-fiberglass composite layered structure (e.g. GLARE). Other layered structures are usable with the face 112, for example: titanium over an elastomer or carbon-fiber composite over a foam. Such composites need not be symmetrical. In another embodiment, the head 102 may include at least a portion that is formed of one or more different materials than the supporting structure of the face 112, which second material may be located at or around the area of highest response 127 of the face 112, or at another location. As shown in FIGS. 4-7 and discussed below, such different materials may be provided in the form of an insert connected to the face 112.

In one embodiment, the thermal modulus response of a material used in the face 112 may be affected by a molecular phase change in the material, due to heat generated during impact of a ball on the ball striking surface. In other words, the material may be formed in a first molecular phase at ambient conditions, and the heat generated by an impact of a ball 106 on the ball striking surface 110 may be sufficient to change the molecular phase of a material to a second molecular phase. The second molecular phase may have a different modulus and/or a different thermal modulus response than the first molecular phase. It is understood that the material may change back to the first molecular phase after impact, and that a molecular phase change of the material may be effected in part by the pressure resulting from an impact, in addition to the resulting heat.

At least a portion of the face 112 may be formed of such a phase-change material, and in one embodiment, at least a portion of the area of highest response 127 of the face 112 is formed of the phase-change material. Additionally, the phase-change material may be incorporated into an insert that is connected to the face 112, such as the inserts 230, 330, 430 of FIGS. 4-7, described below. As similarly described above, the thermal modulus response provided by a phase-change material can be used to produce increased trampoline effect at any swing speed, or to produce greater flexibility at a particular swing speed, among other effects. In one embodiment, heat generated by an impact of a golf ball on the ball striking surface at about 90 to 130 ft/s (or at about 90 ft/s or more) is sufficient to cause a portion of the material local to the impact zone 125 to change to a second molecular phase with a different modulus. It is understood that a swing at a different swing speed may also cause the material to be formed in the second molecular phase. For example, in one embodiment, the material is formed in the second molecular phase as a result of the impact of the golf ball on the ball striking surface at about 90 to 130 ft/s (or at about 90 ft/s or more) and is also formed in the second molecular phase as a result of the impact of the golf ball on the ball striking surface at about 160 ft/s. In other embodiments, materials that undergo phase changes at different heat levels can be used to customize the material to a particular swing speed.

Figure 4:
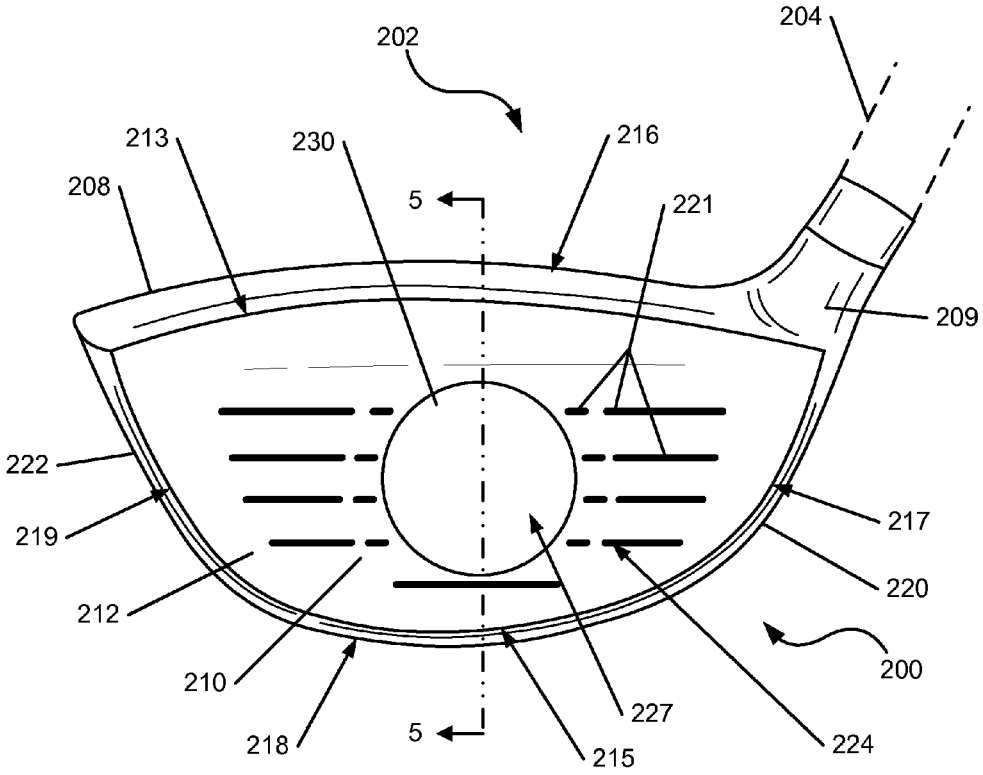
FIG. 4 is a front view of another illustrative embodiment of a wood-type head according to aspects of the present invention, that may be utilized with the ball striking device of FIG. 1.
Figure 5:
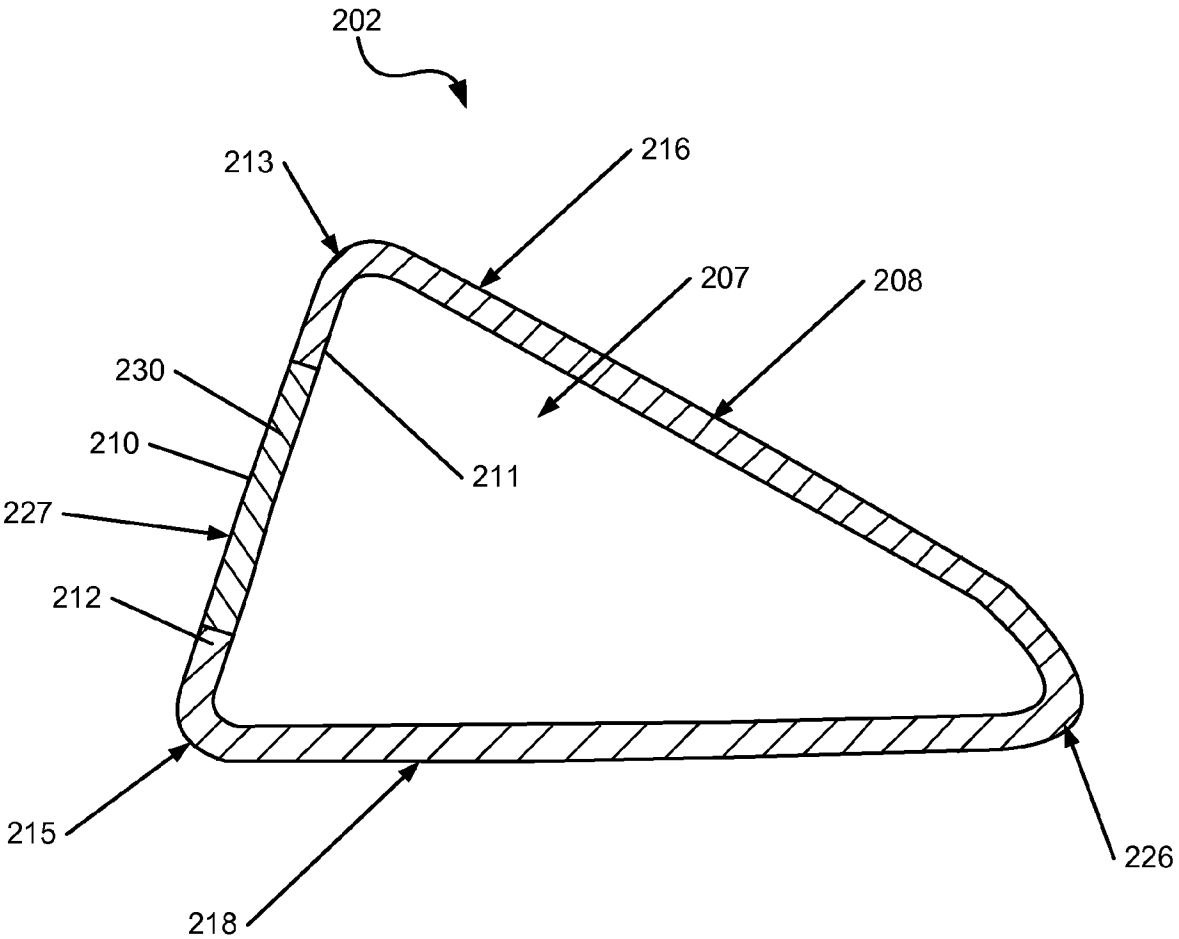
FIG. 5 is a cross-section view of the head of FIG. 4, taken along lines 5-5 of FIG. 2.

In another embodiment, as shown in FIGS. 4-5, the head 202 may include an insert 230 connected to the face 212. Many features of the head 202 of FIGS. 4-5 are similar to the features of the head 102 shown in FIGS. 1-3, and such similar features are identified by similar reference numerals in FIGS. 4-5 using the "2xx" series of reference numerals. Accordingly, certain features of the head 202 of FIGS. 4-5 that are already described above may described below using less detail, or may not be described at all. In this embodiment, the insert 230 is formed of a different material from the face 212, and the material of the insert 230 may have a thermal modulus response that is different from the thermal modulus response of the material of the face 212.

As shown in FIGS. 4-5, the face 212 includes an insert 230 that extends completely through the face 212 and forms part of the ball striking surface 210 and the inner surface 211 of the face 212. In this embodiment, the insert 230 is a circular piece located at or around the area of highest response 227 of the face 112, where impacts are most likely to occur. In other embodiments, the insert 230 may be positioned elsewhere, or may be differently shaped. For example, the insert 230 may be differently shaped or located based on a hitting pattern of a golfer, or the insert 230 may form a larger or smaller proportion of the ball striking surface 210, and may even form a majority or an entirety of the ball striking surface 210. The insert 230 may be connected to the face 212 by adhesives, welding or other integral joining technique, or by another joining technique, including fasteners or other mechanical joining means. In additional embodiments, the insert 230 may be connected to the face 212 in a different configuration, including the configurations in the embodiments of FIGS. 6 and 7.

As described above, the insert 230 may be wholly or partially formed of a material that has a thermal modulus response that is different from the thermal modulus response of the material of the face 212. In other words, the material of the insert 230 may have a modulus that changes at a different rate than the material of the face 112 as a result of heat generated by an impact of a ball 106 on the face 212. This can be used to produce increased trampoline effect at any swing speed, or to produce greater flexibility at a particular swing speed, among other effects. In one embodiment, the material of the insert 230 has a modulus at ambient conditions that is within 5% of the modulus of the material of the face 212 at ambient conditions (e.g., room temperature), and the heat and/or pressure generated by an impact of the ball 106 on the ball striking surface 210 of at least 90 ft/s (or about 90 to 130 ft/s) is sufficient to reduce the modulus of the insert material to at least 20% lower than the modulus of the face material, due to the different thermal modulus responses of the two materials. It is understood that the insert 230 may be formed of multiple materials, any of which may be different from the face material.

Figure 6:
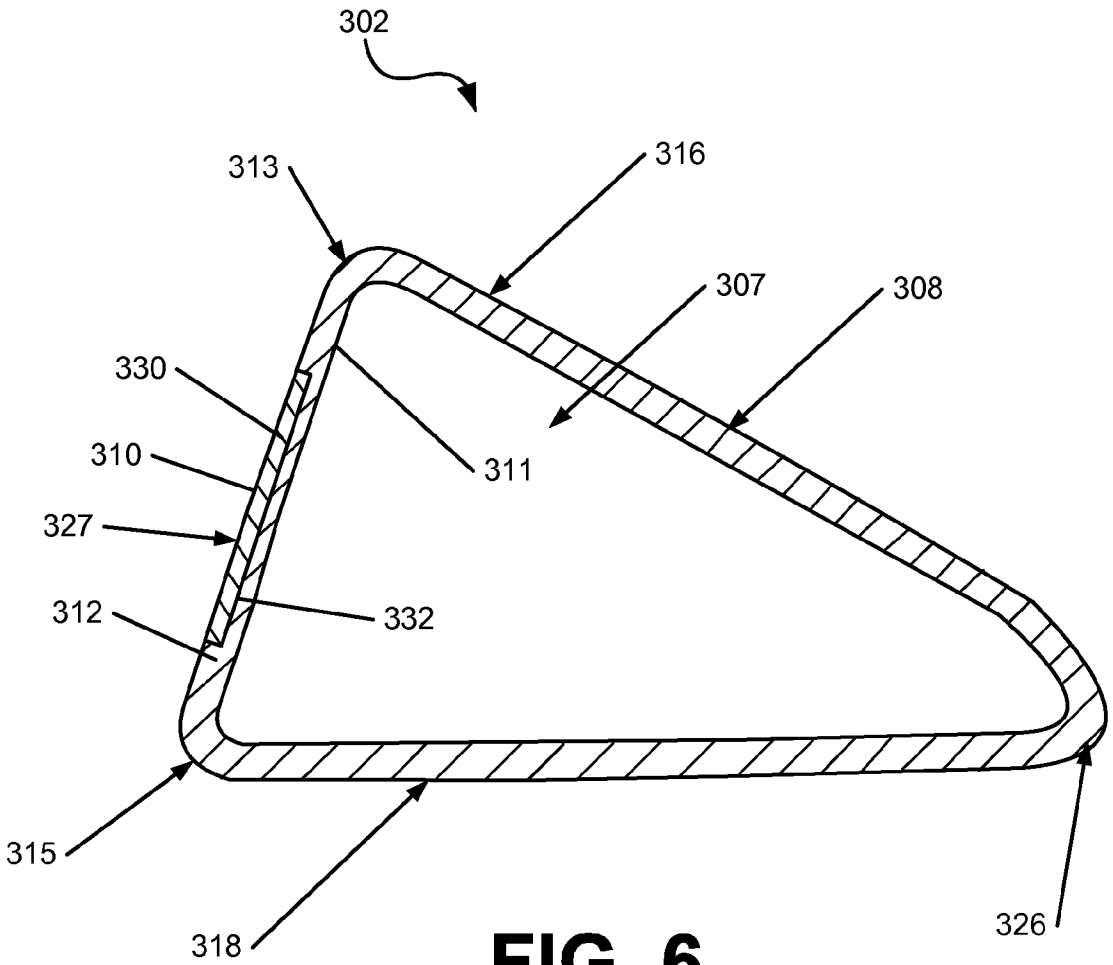
FIG. 6 is a cross-section view of another illustrative embodiment of a wood-type head according to aspects of the present invention, that may be utilized with the ball striking device of FIG. 1.
Figure 7:
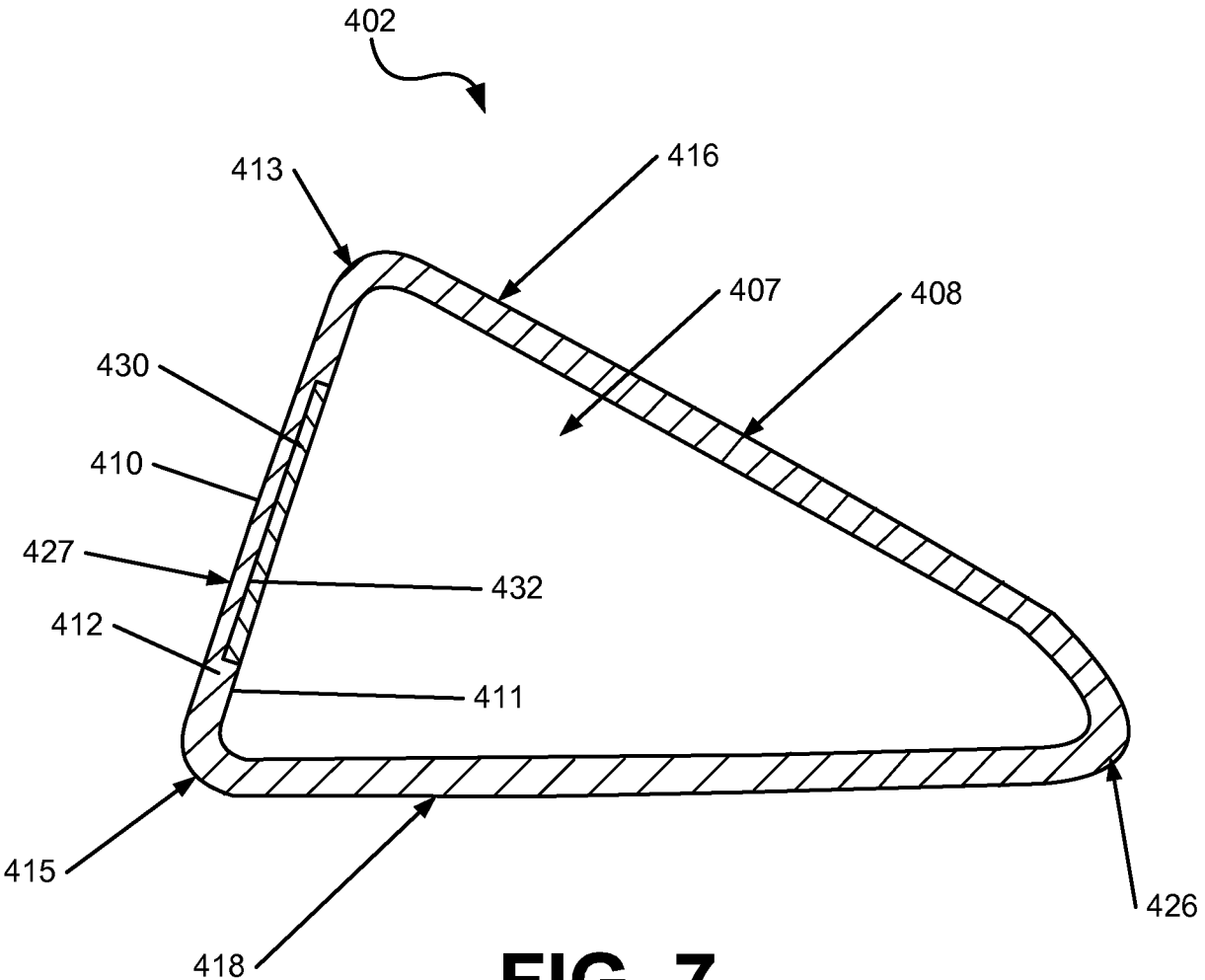
FIG. 7 is a cross-section view of another illustrative embodiment of a wood-type head according to aspects of the present invention, that may be utilized with the ball striking device of FIG. 1.

FIGS. 6 and 7 illustrate other embodiments of heads 302, 402 that include inserts 330, 430 connected to the face 312, 412. Many features of the heads 302, 402 of FIGS. 6 and 7 are similar to the features of the heads 102, 202 shown in FIGS. 1-5, and such similar features are identified by similar reference numerals in FIGS. 6 and 7 using the "3xx" and "4xx" series of reference numerals, respectively. Accordingly, certain features of the heads 302, 402 of FIGS. 6 and 7 that are already described above may described below using less detail, or may not be described at all.

FIG. 6 illustrates an embodiment of a head 302 that includes an insert 330 that is received in a recess 332 in the ball striking surface 310 of the face 312. In this embodiment, the insert 330 forms a portion of the ball striking surface 310. As described above with respect to FIGS. 4-5, the insert 330 can be formed in a circular shape or any other shape, and may be positioned at least partially in the area of highest response 327 of the face 312. Additionally, the insert 330 may be connected within the recess 332 by adhesives, welding or other integral joining technique, or by another joining technique, including fasteners or other mechanical joining means. As also described above, the insert 330 may be wholly or partially formed of a material that has a thermal modulus response that is different from the thermal modulus response of the material of the face 312, which can be used to produce increased trampoline effect at any swing speed, or to produce greater flexibility at a particular swing speed, among other effects. The head 302 of FIG. 6 may include any additional features or variations described above with respect to other embodiments.

FIG. 7 illustrates an embodiment of a head 402 that includes an insert 430 that is received in a recess 432 in the rear surface 411 of the face 412. In this embodiment, the insert 430 is located behind the ball striking surface 410 of the face 412, and forms no portion of the ball striking surface 410. As described above with respect to FIGS. 4-5, the insert 430 can be formed in a circular shape or any other shape, and may be positioned at least partially in the area of highest response 427 of the face 412. Additionally, the insert 430 may be connected within the recess 432 by adhesives, welding or other integral joining technique, or by another joining technique, including fasteners or other mechanical joining means. As also described above, the insert 430 may be wholly or partially formed of a material that has a thermal modulus response that is different from the thermal modulus response of the material of the face 412, which can be used to produce increased trampoline effect at any swing speed, or to produce greater flexibility at a particular swing speed, among other effects. The head 402 of FIG. 7 may include any additional features or variations described above with respect to other embodiments.

Figure 8:
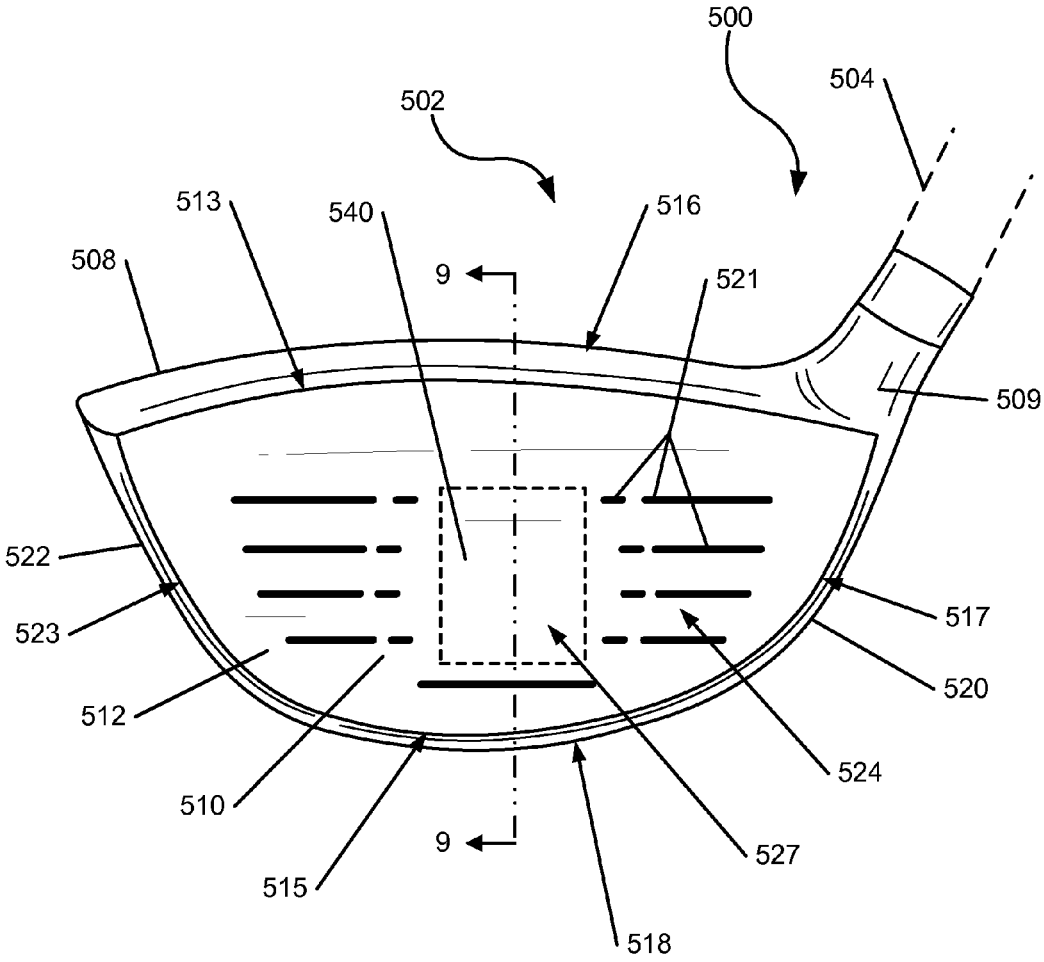
FIG. 8 is a front view of another illustrative embodiment of a wood-type head having a thermoelectric device, according to aspects of the present invention, that may be utilized with the ball striking device of FIG. 1.
Figure 9:
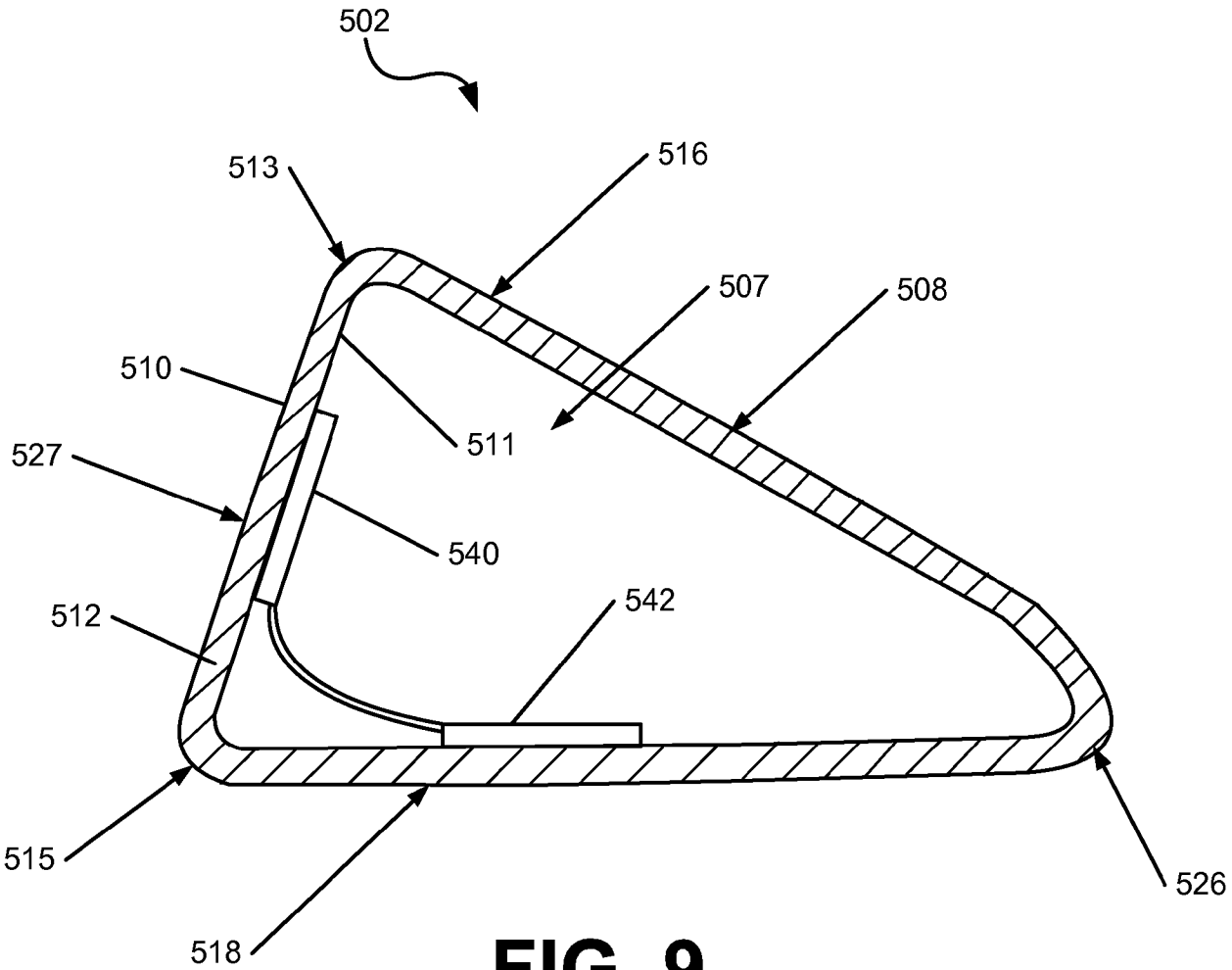
FIG. 9 is a cross-section view of the head of FIG. 8, taken along lines 9-9 of FIG. 8.
Figure 10:
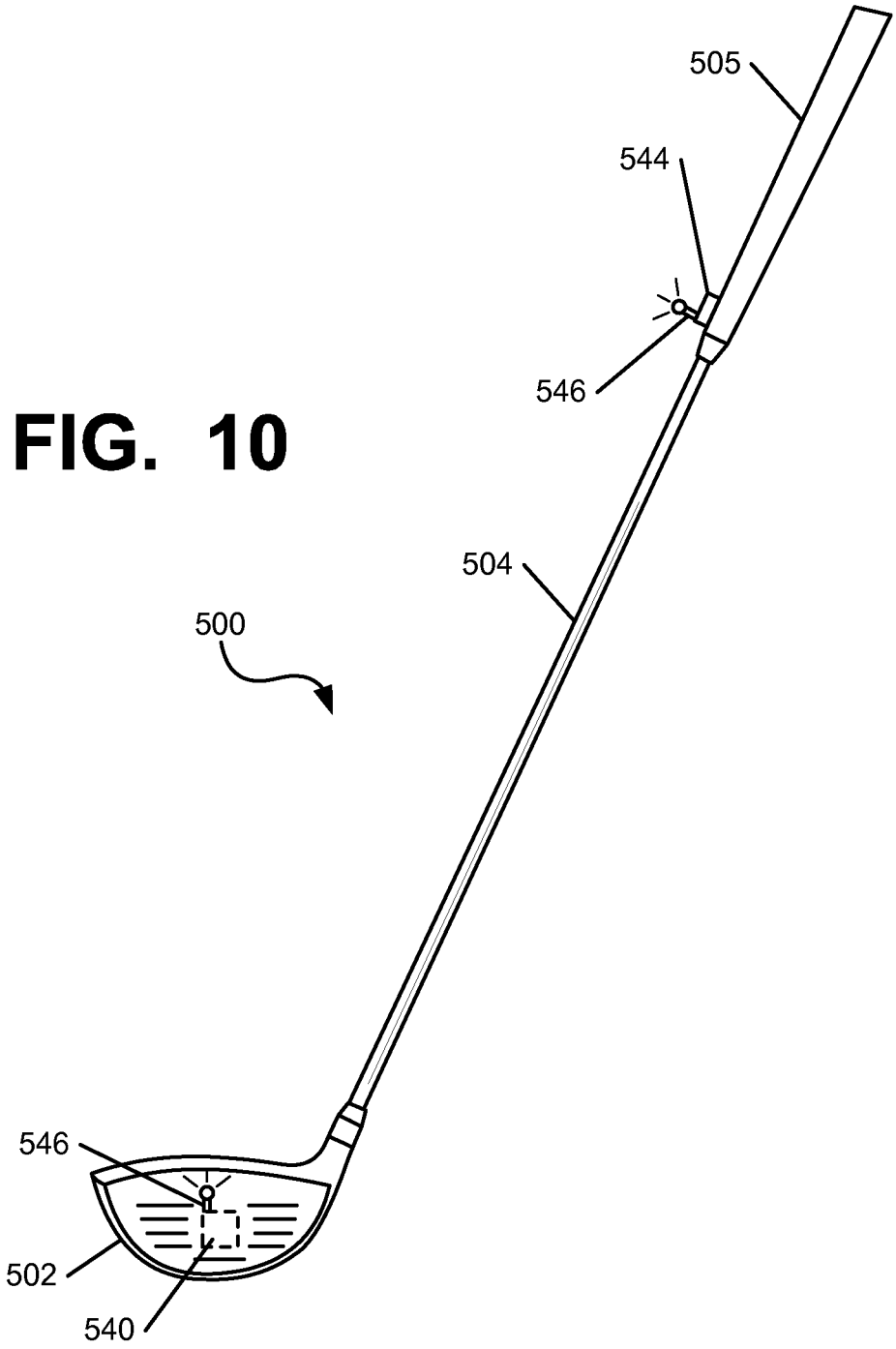
FIG. 10 is a front view of another illustrative embodiment of a wood-type ball striking device containing the head of FIG. 8, according to aspects of the present invention.

In another embodiment, the head 102 may include a thermally-active device that is connected to the face 112 and is configured to change the temperature of at least a portion of the face 112 to effect a change in the modulus of the portion of the face 112. FIGS. 8-10 illustrate one embodiment of ball striking device 500 with a head 502 that includes a thermally-active device 540 connected to the face 512. Many features of the ball striking device 500 and the head 502 of FIGS. 8-10 are similar to the features of the ball striking device 100 and the head 102 shown in FIGS. 1-3, and such similar features are identified by similar reference numerals in FIGS. 8-10 using the "5xx" series of reference numerals. Accordingly, certain features of the ball striking device 500 and the head 502 of FIGS. 8-10 that are already described above may described below using less detail, or may not be described at all.

The thermally-active device 540 may be a heating device designed to heat the face 512, a cooling device designed to cool the face 512, or a device that can selectively heat or cool the face 512. Heating or cooling the face 512 can change the modulus at an area of the face 512, similarly to the heat produced during an impact as described above. The change in modulus may depend on the thermal modulus response of the affected material of the face 512, as described above. Additionally, the change in temperature produced by the device 540 can effect a molecular phase change, as also described above. Accordingly, the thermally-active device 540 may be used in conjunction with the embodiments described above, utilizing materials with thermally-variable moduli.

The device 540 can effect a temperature change by using electrical power, chemical or thermodynamic reaction, or other means or combination of means. In one embodiment, illustrated in FIG. 9, the device 540 is a thermoelectric device that is connected to a power source 542, such as a battery, to supply power to the device 540. The device 540 uses electrical power generated by the power source 542 to change the temperature of the face 512. In this embodiment, the device 540 is connected to the inner surface 511 of the face 512, within the inner cavity 507, and the power source 542 is also located within the inner cavity 507. One example of a thermoelectric heating device 540 is a thermoelectric generator, and one example of a thermoelectric cooling device 540 is a Peltier cooler. In another embodiment, the device 540 may be a chemical device, which may create temperature changes through exothermic or endothermic chemical/thermodynamic reactions. Such a chemical device may also include an electrical power source 542, providing power to operate the device 540.

The device 540 may be utilized to change the temperature of any a portion of the face 512, including the entire face 512, the majority of the face 512, or a selected area of the face 512. It is understood that the device 540 may change the temperature of a portion of the face 512 local to the device 540, relative to a portion of the face 512 spaced from the device 540. In one embodiment, as illustrated in FIGS. 8-10, the device 540 is configured to change the temperature of at least a portion of the area of highest response 527, located near the geometric center of the face 512. In other embodiments, the device 540 may be configured to change the temperature of a different portion of the face 512. For example, the head 502 may include a thermally-active device 540 that is designed to change the temperature of a ring-shaped area surrounding the center of the face 512. In one embodiment, increasing the modulus of the portions of the face 512 surrounding the area of highest response 527, the trampoline effect in the area of highest response 527 can be augmented. Still further configurations are possible within the scope of the invention.

The device 540 may also be controllable by the user of the ball striking device 500. In the embodiment illustrated in FIGS. 8-10, the ball striking device 500 includes an actuator 544 in communication with the device 540, configured to activate the device 540 to change the temperature of the face 512. As shown in FIG. 10, the actuator 544 is located on the shaft 504 of the ball striking device 500, and may be located within or proximate to the grip 505, in order to provide a convenient and accessible location for the user. The actuator 544 may include a button, a switch, or other such device. In one example, the actuator 544 may include a toggle switch to set the device 540 in a specific mode of operation, such as an ON/OFF switch, a HEAT/COOL switch, a HEAT/COOL/OFF switch, or other such switch. In another example, the actuator may include a button that causes the device 540 to activate when pressed and deactivate when released or pressed again. Further different types of actuators 544 may be used in other embodiments. Additionally, in the embodiment of FIG. 10, the actuator 544 is in wireless communication with the device 540, using wireless antennae 546 on the actuator 544 and the device 540. Such wireless communication can be accomplished by any means, including RF signals, infrared or other optical signals, etc. In another embodiment, the actuator 544 and the device 540 may communicate in another manner, such as by wired connection. In a further embodiment, the actuator 544 may be an integrated part of the device 540 itself In yet another embodiment, the device 540 may be automatically activated, such as by using an accelerometer to determine when a swing of the ball striking device 500 has begun.

Figure 11:
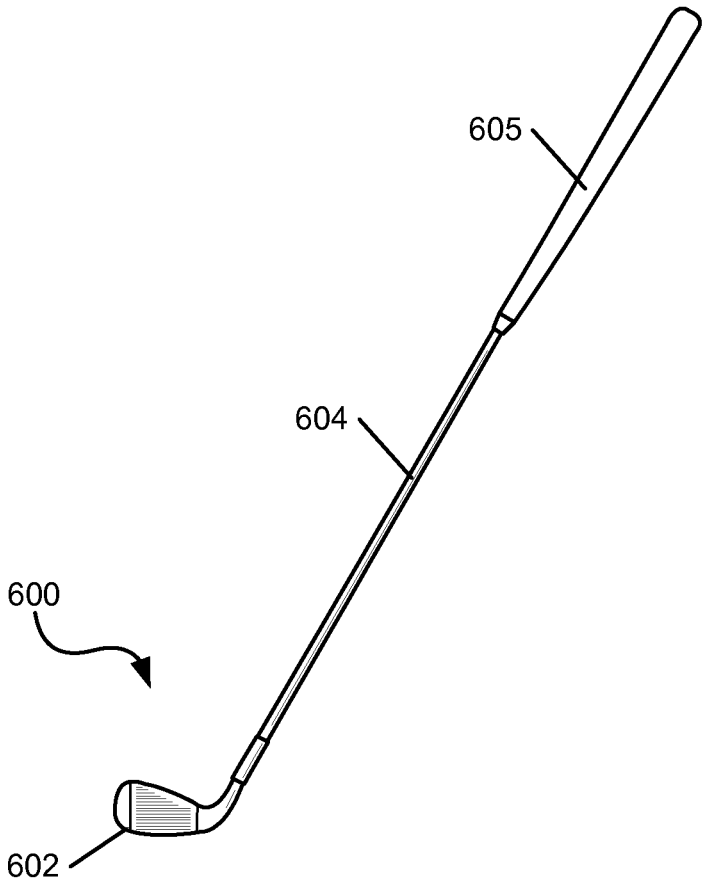
FIG. 11 is a front view of an illustrative embodiment of an iron-type ball striking device according to aspects of the present invention.
Figure 12:
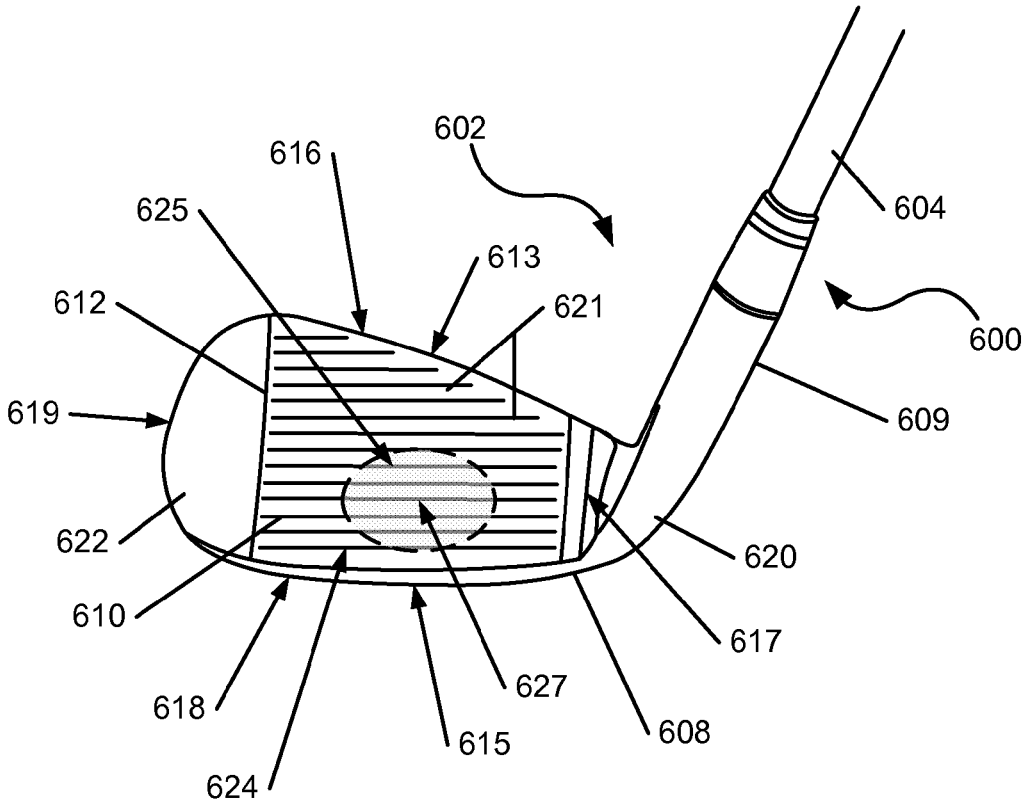
FIG. 12 is a front view of a head of the iron-type ball striking device of FIG. 11.

FIGS. 11-12 illustrate a ball striking device 600 in the form of a golf iron, in accordance with at least some examples of this invention. Many common components between the ball striking device 100 of FIGS. 1-3 and the ball striking device 600 of FIGS. 11-12 are referred to using similar reference numerals in the description that follows, using the "600" series of reference numerals. The ball striking device 600 includes a shaft 604 and a golf club head 602 attached to the shaft 604. The golf club head 602 of FIG. 4 may be representative of any iron or hybrid type golf club head in accordance with examples of the present invention.

As shown in FIGS. 11-12, the golf club head 602 includes a body member 608 having a face 612 and a hosel 609 extending from the body 608 for attachment of the shaft 604. For reference, the head 602 generally has a top 616, a bottom or sole 618, a heel 620 proximate the hosel 609, a toe 622 distal from the hosel 609, a front 624, and a back or rear 626. The shape and design of the head 602 may be partially dictated by the intended use of the device 600. The heel portion 620 is attached to and/or extends from a hosel 609 (e.g., as a unitary or integral one piece construction, as separate connected elements, etc.).

The face 612 is located at the front 624 of the head 602, and has an outer surface 610, as well as a rear surface 611 located opposite the outer surface 610, which may be considered an inner surface of the face 612. The face 612 is defined by a plurality of peripheral edges, including a top edge 613, a bottom edge 615, a heel edge 617, and a toe edge 619. The face 612 also has a plurality of face grooves 621 on the ball striking surface 610. For reference purposes, the portion of the face 612 nearest the top face edge 613 and the heel 620 of the head 602 is referred to as the "high-heel area"; the portion of the face 612 nearest the top face edge 613 and toe 622 of the head 602 is referred to as the "high-toe area"; the portion of the face 612 nearest the bottom face edge 615 and heel 620 of the head 602 is referred to as the "low-heel area"; and the portion of the face 612 nearest the bottom face edge 615 and toe 622 of the head 602 is referred to as the "low-toe area". Conceptually, these areas may be recognized and referred to as quadrants of substantially equal size (and/or quadrants extending from a geometric center of the face 612), though not necessarily with symmetrical dimensions. The face 612 may include some curvature in the top to bottom and/or heel to toe directions (e.g., bulge and roll characteristics), as is known and is conventional in the art. The ball striking surface 610 is inclined (i.e., at a loft angle), to give the ball an appreciable degree of lift and spin when struck. In various embodiments, the ball striking surface 610 may have a different incline or loft angle, to affect the trajectory of the ball.

The body member 608 of the golf club head 602 may be constructed from a wide variety of different materials, including materials conventionally known and used in the art, such as steel, titanium, aluminum, tungsten, graphite, polymers, or composites, or combinations thereof. Also, if desired, the club head 602 may be made from any number of pieces (e.g., having a separate face plate, etc.) and/or by any construction technique, including, for example, casting, forging, welding, and/or other methods known and used in the art.

The ball striking device 600 may include a shaft 604 connected to or otherwise engaged with the ball striking head 602, as shown in FIG. 11 and described above. The shaft 604 is adapted to be gripped by a user to swing the ball striking device 600 to strike the ball. The shaft 604 can be formed as a separate piece connected to the head 602, such as by connecting to the hosel 609, as shown in FIG. 11. Any desired hosel and/or head/shaft interconnection structure may be used without departing from this invention, including those described above.

Figure 13:
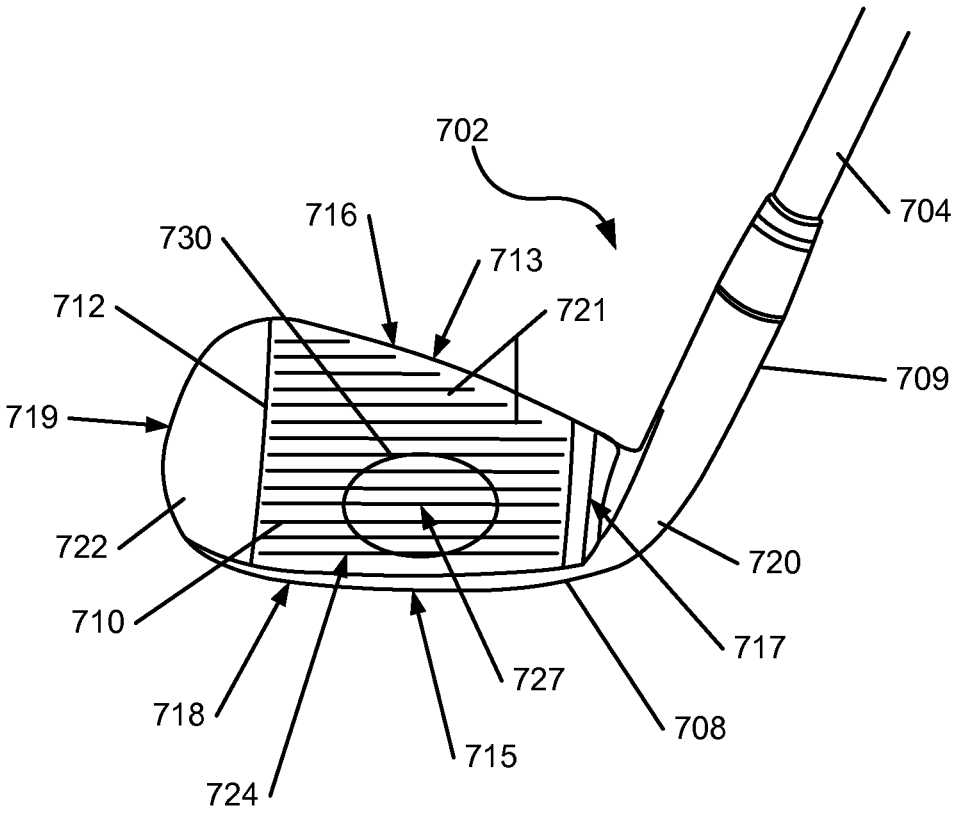
FIG. 13 is front view of another illustrative embodiment of an iron-type head according to aspects of the present invention, that may be utilized with the ball striking device of FIG. 11.
Figure 14:
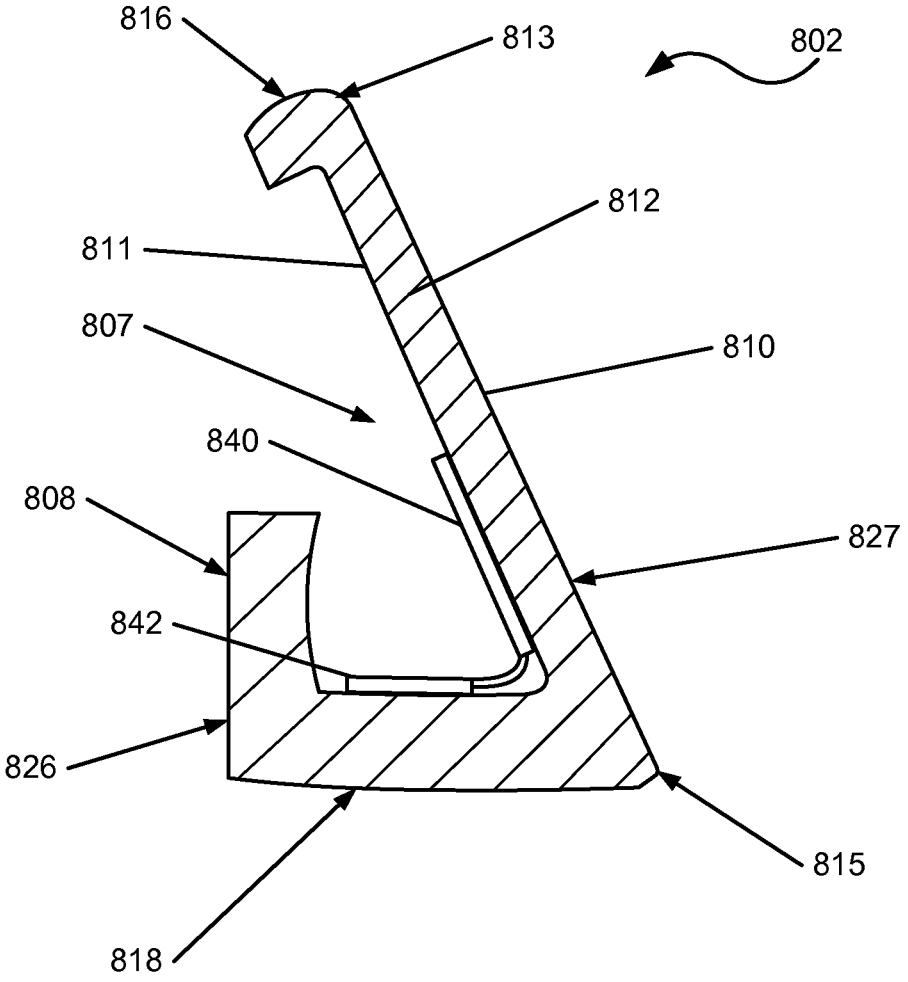
FIG. 14 is cross-section view of another illustrative embodiment of an iron-type head having a thermoelectric device, according to aspects of the present invention, that may be utilized with the ball striking device of FIG. 11.

In general, FIGS. 11-12 illustrate a head 602 that has a face 612 that is at least partially formed of a material with a thermally-variable modulus, as described above. A potential impact zone 625 of a ball 106 on the area of highest response 627 of the face 612 is illustrated in FIG. 12, and in one embodiment, the face 612 includes one or more materials that have a thermal modulus response that changes the modulus of the areas of the face 612 local to the impact zone, based on heat generated during impact. The thermal modulus response of the material can be used to produce increased trampoline effect at any swing speed, or to produce greater flexibility at a particular swing speed, among other effects, as also described above, including the performances described above for specific swing speeds. Any materials, configurations, and variations described above can be used in connection with an iron-type head, such as the head 602 illustrated in FIGS. 11-12. As one example, the face 612 may be made of a single material with a favorable thermal modulus response, or of multiple materials, and may utilize an insert, such as the inserts 230, 330, 430 in FIGS. 4-7. FIG. 13, described below, illustrates an iron-type head 702 that includes an insert 730. As another example, the face 612 may incorporate a phase-change material, as described above. As a further example, the head 602 may include a thermally active device, such as the device 540 in FIGS. 8-10. FIG. 14, described below, illustrates an iron-type head 802 that includes a thermally-active device 840. Still other variations and configurations are possible, including those described elsewhere herein.

FIG. 13 illustrates an embodiment of a head 702 that includes an insert 730 that is connected to the face 712 thereof Many features of the head 702 of FIG. 13 are similar to the features of the heads 102, 202, 302, 402 and 602 shown in FIGS. 1-7 and 11-12, and such similar features are identified by similar reference numerals in FIG. 13 using the "7xx" series of reference numerals. Accordingly, certain features of the head 702 of FIG. 13 that are already described above may described below using less detail, or may not be described at all. In this embodiment, the insert 730 forms a portion of the ball striking surface 710. As similarly described above with respect to FIGS. 4-5, the insert 730 can be formed in a circular shape or any other shape, and may be positioned at least partially in the area of highest response 727 of the face 712. The insert 730 may be connected within a recess in the ball striking surface 710 or the inner surface (not shown) of the face 712, such as in FIGS. 6-7, or may extend completely through the face 712, such as in FIGS. 4-5. Additionally, the insert 730 may be connected to the face 712 by adhesives, welding or other integral joining technique, or by another joining technique, including fasteners or other mechanical joining means. As also described above, the insert 730 may be wholly or partially formed of a material that has a thermal modulus response that is different from the thermal modulus response of the material of the face 712, which can be used to produce increased trampoline effect at any swing speed, or to produce greater flexibility at a particular swing speed, among other effects. The head 702 of FIG. 13 may include any additional features or variations described above with respect to other embodiments.

FIG. 14 illustrates an embodiment of a head 802 that includes a thermally-active device 840 that is connected to the face 812 and is configured to change the temperature of at least a portion of the face 812. Many features of the head 802 of FIG. 14 are similar to the features of the heads 102, 502, and 602 shown in FIGS. 1-3 and 8-12, and such similar features are identified by similar reference numerals in FIG. 14 using the "8xx" series of reference numerals. Accordingly, certain features of the head 802 of FIG. 14 that are already described above may be described below using less detail, or may not be described at all. In this embodiment, the head 802 includes a thermally-active device 840 configured similarly to the device 540 described above with respect to FIGS. 8-10. Any features, configurations, or variations described above with respect to the head 502 and the device 540 of FIGS. 8-10, or of any other embodiments described above, may be utilized in connection with the head 802 and the thermally-active device 840 of FIG. 14. As shown in FIG. 14, the rear surface 811 of the face 812 and the body 808 of the head 802 define a rear cavity 807 in the head 802. In this embodiment, both the thermally-active device 840 and the power supply 842 are located behind the rear surface 811 of the face 812 and within the rear cavity 807.

Several different embodiments have been described above, including the various embodiments of golf clubs 100, 500, 600 and heads 102, 202, 302, 402, 502, 602, 702, 802 and portions thereof described herein. It is understood that any of the features of these various embodiments may be combined and/or interchanged. For example, as described above, various different combinations of club heads 102, et seq. with differently configured face materials, including different inserts, may be used, including the configurations described herein, variations or combinations of such configurations, or other configurations. In further embodiments, at least some of the features described herein can be used in connection with other configurations of iron-type clubs, wood-type clubs, other golf clubs, or other types of ball-striking devices.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head with a face that is formed at least partially of a material with a thermally-variable modulus and/or other features described herein.

Additionally, as described above, the head 102, et seq., golf club 100, et seq., or other ball striking device may be fitted or customized for a person by selecting a material or combination of materials that have an appropriate thermal modulus response based on the typical swing speed of a particular golfer. Additionally, the size, shape, and location of any face inserts 230, et seq., utilized herein may be adjusted based on a common hitting pattern of a golfer. Further, inserts may be interchanged or replaced based on customization to a particular golfer or customization to specific play conditions. Still other options for customization are possible.

The ball striking devices and heads therefor as described herein provide many benefits and advantages over existing products. For example, the thermal modulus response of one or more selected materials can be used to produce increased trampoline effect at any swing speed, or to produce greater flexibility at a particular swing speed, among other effects. The use of inserts provide further options for customization to a particular golfer and/or swing speed. A thermally-active device may permit the golfer to have greater control over the modulus of the face of his/her golf club. Thus, the golfer can adjust the flexibility of the face based on the golfer's typical performance and/or specific play conditions. Further benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having a ball striking surface and an inner surface opposite the ball striking surface, the face having an area of highest response located proximate a center of the ball striking surface, wherein the face is formed of a first material and further comprises an insert forming at least a portion of the area of highest response, the insert being formed of a second material having a thermal modulus response that is different from a thermal modulus response of the first material, wherein the thermal modulus response of the second material is configured such that heat generated by an impact of a golf ball striking surface of at least 90 ft/s is sufficient to reduce a modulus of the second material by at least 10% relative to the modulus of the second material at ambient conditions; and a body connected to the face and extending rearward from the face.

2. The golf club head of claim 1, wherein the insert is located behind the ball striking surface, such that an entirety of the ball striking surface is formed of the first material.

3. The golf club head of claim 1, wherein the insert is located within a recess on the inner surface, such that an entirety of the ball striking surface is formed of the first material.

4. The golf club head of claim 1, wherein the insert forms at least a portion of the ball striking surface.

5. The golf club head of claim 1, wherein the modulus of the second material at ambient conditions is within 5% of a modulus of the first material at ambient conditions, and wherein heat generated by an impact of a golf ball on the ball striking surface of at least 90 ft/s is sufficient to reduce the modulus of the second material to at least 20% lower than the modulus of the first material, due to the different thermal responses of the first and second materials.

6. A golf club comprising the golf club head of claim 1 and a shaft connected to the head.

7. A wood-type golf club head comprising:

a face having a ball striking surface and an inner surface opposite the ball striking surface, the face having an area of highest response located proximate a center of the ball striking surface, wherein at least a portion of the area of highest response is formed of a material with a thermally-variable modulus such that the material has a first modulus due to heat generated by an impact of a golf ball on the ball striking surface at about 90 to 130 ft/s and a second modulus due to heat generated by an impact of the golf ball on the ball striking surface at about 160 ft/s, the second modulus being no more than 5% different from the first modulus, and wherein the material has a third modulus at ambient conditions, the third modulus being at least 20% greater than the first modulus; and a wood-type body connected to the face and extending rearward from the face, the body and the face defining an internal cavity behind the face.

8. The wood-type golf club head of claim 7, wherein the material forming the at least a portion of the area of highest response is formed by an insert connected to the face.

9. The wood-type golf club head of claim 8, wherein a majority of the face is formed of a second material having a thermal modulus response that is different from a thermal modulus response of the material of the insert.

10. The wood-type golf club head of claim 7, wherein the material is formed in a first molecular phase at ambient conditions, and the heat generated by an impact of a golf ball on the ball striking surface at about 90 to 130 ft/s is sufficient to cause a portion of the material local to an impact site to undergo a heat-induced phase change to a second molecular phase, the second molecular phase having a lower modulus than the first molecular phase.

11. A wood-type golf club comprising the wood-type golf club head of claim 7 and a shaft connected to the head.

12. A golf club head comprising:

a face having a ball striking surface and an inner surface opposite the ball striking surface, the face having an area of highest response located proximate a center of the ball striking surface, wherein at least a portion of the area of highest response is formed of a material, the material being formed in a first molecular phase at ambient conditions, wherein heat generated by an impact of a golf ball on the ball striking surface at about 90 ft/s or more is sufficient to cause a portion of the material local to an impact site to undergo a heat-induced phase change to a second molecular phase, the second molecular phase having a different modulus than the first molecular phase, and wherein that heat generated by the impact of the golf ball on the ball striking surface at about 90 ft/s or more is sufficient to reduce a modulus of the material by at least 10% relative to the modulus of the material at ambient conditions; and a body connected to the face and extending rearward from the face.

13. The golf club head of claim 12, wherein the material has a first modulus due to heat generated by an impact of a golf ball on the ball striking surface at about 90 to 130 ft/s and a second modulus due to heat generated by an impact of the golf ball on the ball striking surface at about 160 ft/s, the second modulus being no more than 5% different from the first modulus.

14. The golf club head of claim 13, wherein the material is formed in the second molecular phase as a result of the impact of the golf ball on the ball striking surface at about 90 to 130 ft/s and is also formed in the second molecular phase as a result of the impact of the golf ball on the ball striking surface at about 160 ft/s.

15. The golf club head of claim 12, wherein the material forming the at least a portion of the area of highest response is formed by an insert connected to the face.

16. The golf club head of claim 15, wherein a majority of the face is formed of a second material having a thermal modulus response that is different from a thermal modulus response of the material of the insert.

17. The golf club head of claim 15, wherein the insert is located behind the ball striking surface, such that an entirety of the ball striking surface is formed of the first material.

18. The golf club head of claim 15, wherein the insert forms at least a portion of the ball striking surface.

19. A golf club comprising the golf club head of claim 12 and a shaft connected to the head.

* * * * *